United States Patent [19]

Achelpohl et al.

[11] 4,235,366

[45] Nov. 25, 1980

[54] PLASTICS SACK WITH INTERNAL CLOSURE MEMBER, BASE COVER SHEET AND EMPTYING MEANS

[75] Inventors: Fritz Achelpohl, Lengerich; Horst Schmidt, Kattenvenne, both of Fed. Rep. of Germany

[73] Assignee: Windmöller & Hölscher, Lengerich, Fed. Rep. of Germany

[21] Appl. No.: 967,994

[22] Filed: Dec. 11, 1978

[30] Foreign Application Priority Data

Dec. 13, 1977 [DE] Fed. Rep. of Germany ..... 2755514

[51] Int. Cl.[3] ..... B65D 33/38

[52] U.S. Cl. ..... 229/60; 229/62

[58] Field of Search ..... 229/60, 58, 62, 62.5; 150/9

[56] References Cited

U.S. PATENT DOCUMENTS

| | | | |
|---|---|---|---|
| 1,947,934 | 2/1934 | Geimer | 229/62 |
| 2,771,010 | 11/1956 | Piazze | 229/60 X |
| 2,948,457 | 8/1960 | Thiele | 229/62 |
| 3,373,918 | 3/1968 | Krings | 229/62.5 X |

FOREIGN PATENT DOCUMENTS

| | | | |
|---|---|---|---|
| 836432 | 4/1952 | Fed. Rep. of Germany | 229/62.5 |
| 21118 | 10/1956 | Fed. Rep. of Germany | 229/62.5 |
| 1025255 | 2/1958 | Fed. Rep. of Germany | 229/62.5 |
| 1545966 | 11/1966 | France | 229/58 |
| 875848 | 8/1961 | United Kingdom | 229/62.5 |

*Primary Examiner*—Stephen P. Garbe

*Attorney, Agent, or Firm*—Fleit & Jacobson

[57] ABSTRACT

A plastics sack made from tubular material has one end of the tube folded to form a base defined by two triangular tucks interconnected by a welded-on or heat sealed joining strip, and two side flaps which incorporate the ends of the joining strip. A cover sheet is adhered over part of the corner tucks and over only one of the side flaps. The other side flap can be pulled out from beneath the cover sheet to form a controlled outlet for the sack contents or is temporarily secured to the outside of the cover sheet so that it can be readily detached for the same purpose.

6 Claims, 5 Drawing Figures

FIG.1
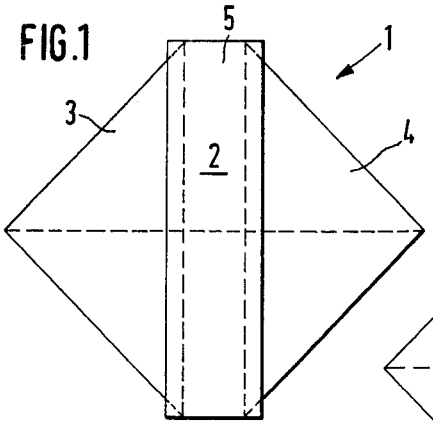
FIG.4
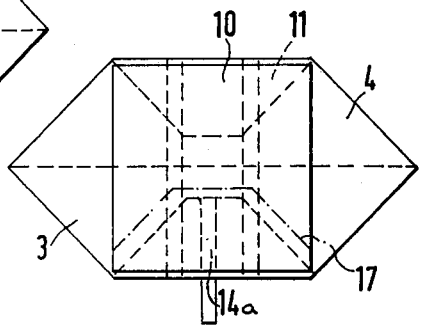
FIG. 2
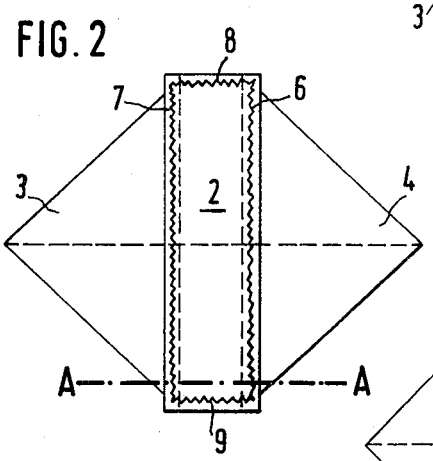
FIG.5
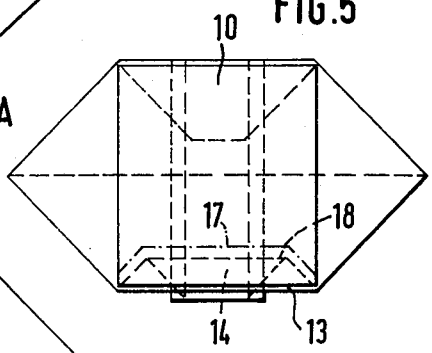
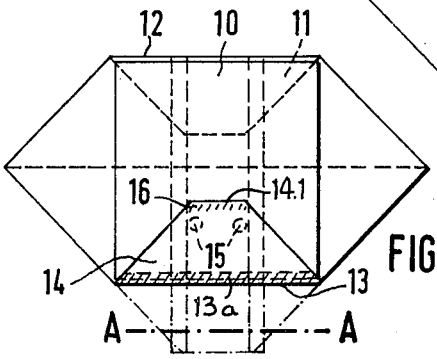
FIG.3

PLASTICS SACK WITH INTERNAL CLOSURE MEMBER, BASE COVER SHEET AND EMPTYING MEANS

The invention relates to a plastics sack which is made from a tube section and of which the base consists of corner tucks formed by pulling the end of the tube section open, the corner tucks being partially covered by an internal closure member, and a base cover sheet applied in the region of the inwardly folded base side flaps.

Federal Republic of Germany Published Application No. 26-47-432 suggests a sack made from a tube section of woven plastics threads or woven plastics tapes coated or laminated on the outside with plastics film and able to contain pourable material of a weight of 1 t and more because of its size and the strength of its material. For transporting purposes, such large sacks can be suspended from the hook of a crane at their gathered filling ends, for example with interposed lifting tackle, and lifted by the associated lifting gear, displaced, and moved. A particular problem in the manipulation of such large sacks results from the need for emptying them in a simple manner. For example, it may be necessary to empty the large sacks into a filling funnel so as to be able to process their contents further or use them up. Since the large sacks are suspended with their filling aperture in the hook of a crane by way of an interposed coupling member, it would be possible to lift the sacks above the funnel and open them at the base by cutting with a knife. However, this would not only destroy the large sack but an aperture produced by a cut would not enable the material in the sack to be dispensed in a controlled manner.

It is therefore the problem of the present invention to provide a large sack which can be emptied from the base without destruction.

This problem is solved according to the invention in a sack of the aforementioned kind in that the internal closure member is welded to the corner tuck and to the edges of the exposed part of the inner surface of the tube disposed between the corner tucks, the base cover sheet covers only one of the inwardly folded base side flaps and is adhered thereto, to the adjoining base portion and to the base portion lying under the other base side flap, and that the other base side flap is folded onto the base cover sheet from the outside and is releasably adhered thereto. The plastics sack according to the invention, which may consist of a single-layer or multi-ply film or a coated or laminated weave of plastics tape can be emptied at the base in a simple manner after lifting in that the base side flap which is tacked onto the base cover sheet is torn off and its welded front edge is cut off. The base side flap released from the base closure will, after it has been opened, form an outlet funnel which permits quantities to be dispensed.

The base side flap may be adhered onto the base cover sheet by dabs of adhesive or a non-setting adhesive so that it is possible to release it for the purpose of emptying the sack.

The emptied sack can be readily closed again at the base by welding the aperture of the base side flap shut, turning the latter over again and adhering it to the base cover sheet again. It is therefore possible to use the sacks according to the invention several times if this should be desired.

To prevent the material from penetrating beyond the edge of the base fold in the base side flap tacked to the base cover sheet, the side flap may be provided with a releasable adhesion in its interior. This adhesion can again be formed by dabs of adhesive or by an application of permanently tacky non-setting adhesive.

In another form of the invention, both base side flaps may be covered by the base cover sheet, one base side flap remaining unadhered to the base cover sheet. This base side flap can then be pulled out from under the base cover sheet and opened by a cut parallel to the weld seam. To prevent adhesion to the base cover sheet of the withdrawable base side flap that is covered by the base cover sheet, the base cover sheet may, for the purpose of its adhesion to the base, be provided with a dimensioned application of adhesive in such a way that the base side flap remains in the region that is free from adhesive. To prevent adhesion of the base side flap, it can also be covered by an inserted paper blank which is then stuck to the base cover sheet instead of the base side flap. Finally, the base side flap need not be pretreated at all so that the adhesive will not stick to it.

To simplify pulling out of the base side flap that is covered by the base cover sheet but not stuck thereto, a further form of the invention provides that the base side flap which is not adhered to the base cover sheet is folded back on itself such that its front edge closed by a weld seam projects beyond the base cover sheet.

Finally, a pull strip projecting beyond the base cover sheet may be connected to the front edge region of the base side flap that is fully covered by the base cover sheet, the pull strip enabling the base side flap to be pulled out from under the base cover sheet.

In another embodiment of the invention, it may be provided that a known valve tube is placed in the base and can be opened by a spreading member. The valve tube is desirably closed by a weld seam at the end projecting beyond the base cover sheet.

To provide an outlet aperture for the material, various means may be provided which separate the superposed walls of the valve tube from one another so that an outlet aperture is created. Spreading members may be provided which can be introduced from the outside or those which are disposed in the valve tube. For example, a spreading member lying flat in the valve tube may be erectable by a pull member to the position where it opens the valve tube.

An example of the invention will now be described in more detail with reference to the drawing in which:

FIG. 1 is a plan view of a tube section which has been pulled open to form a square base and has an internal closure member placed thereon;

FIG. 2 is a view similar to FIG. 1 of the pulled-open base with the internal closure member welded thereon;

FIG. 3 shows a base which has been folded shut and closed by a base cover sheet onto which a base side flap has been tacked on the outside by dabs of adhesive;

FIG. 4 shows a base which has been folded shut and closed by a base cover sheet but has been adhered to only one base side flap, and FIG. 5 is a view similar to FIG. 4 of the base which has been closed by a base cover sheet and in which the base side flap that is not adhered to the base cover sheet is folded back on itself.

FIG. 1 shows a coated length of tube 1 of woven tape that has been pulled open to form a square base 2 while forming the corner tucks 3, 4. The internal closure member 5 has been placed on the square base in such a way that it covers the edges of the corner tucks 3, 4.

It will be seen from FIG. 2 that the internal closure member 5 is welded to the edges of the corner tucks 3, 4 by weld seams 6, 7 and to the inner face of the tube section between the corner tucks by the weld seams 8, 9.

As will be evident from FIG. 3, the base is closed by turning the side flap 11 about the fold line 12 and adhering it to the base of the base cover sheet 10 over all of its area.

The base side flap 14 is subsequently turned onto the base cover sheet 10 about the fold line 13 and located thereon by dabs 15 of glue or strips 16 of glue. To prevent the material from penetrating beyond the edge of the base fold in the base side flap tacked to the base cover sheet, the side flap is provided with a releasable adhesion coating 13*a* in its interior. Also, a weld seam 14.1 closes an end of the base side flap 14 that projects beyond the base cover sheet 10.

To open the filled sack, the base side flap 14 fixed to the base cover sheet by the applications of glue is torn off so that it assumes the position shown in broken lines in FIG. 3. To open the base, the end portion of the base side flap 14 is cut off with the weld seam 9 along the chain-dotted line A—A so that an emptying orifice is formed. Through this emptying orifice the large sack, which can for example be suspended from a crane, can be readily emptied into a funnel in a controlled manner.

FIG. 4 illustrates a different embodiment of a base in which the base side flap 14 folded about the fold line 13 but not adhered to the base cover sheet 10 is also covered by the base cover sheet 10. To prevent adhesion to the base side flap 14, the base cover sheet 10 is provided with a full surface adhesive application only above the chain-dotted line 17. The base side flap not adhered to the base cover sheet 10 can be pulled out of the pocket formed between the base cover sheet 10 and the base of the sack and subsequently opened in the same way as has been described with reference to FIG. 3. Alternatively, a pull strip 14*a* projects beyond the base cover sheet 10 and is connected to a front edge region of the base side flap 14 that is fully covered by the base cover sheet. The pull strip enables pulling of the base side flap out from under the base cover sheet.

In the embodiment shown in FIG. 5, the base side flap 14 folded about the fold line 13 is folded back on itself about the fold line 18 shown in broken lines so that the end of the base side flap 14 provided with the weld seam projects beyond the base cover sheet 10 in the illustrated manner. The base cover sheet 10 is again provided with a full surface adhesive application above the chain-dotted line 17 so that it will not adhere to the base side flap which is folded about the fold line 13 and folded back on itself. The base side flap which is again securely held in the pocket formed by the base cover sheet and the wall of the sack can be pulled out more easily for the purpose of opening it because the end of the base side flap can be grasped.

We claim:

1. A plastics sack formed from a tube section and having a base, the base being formed by pulling an end of the tube section open to form corner tucks of generally triangular shape, the tucks having facing bases spaced apart by an exposed region of an inner surface of the tube section; a closure member covering and welded to the exposed region and portions of the corner tucks, end portions of the closure member and end portions of the bases of the tucks defining side flaps, the side flaps having portions thereof folded back onto the base; and a base cover sheet adhered to and covering at least a first of the folded back side flaps and being adhered to the closure member, and portions of the tucks; a second of the folded back side flaps being movable with respect to the base cover sheet to define a funnel for emptying the plastics sack.

2. The plastics sack according to claim 1, wherein the second of the folded back side flaps is folded onto the base cover sheet and releasably adhered thereto.

3. The plastics sack according to claim 2, wherein interior surfaces of the tube section forming the second folded back side flap are releasably adhered to each other in a region adjacent the fold line of the folded side flap.

4. The plastics sack according to claim 1, wherein the base cover sheet covers both of the folded back side flaps.

5. The plastics sack according to claim 4, wherein the second folded back side flap is folded back on itself a second time so that a portion of the side flap projects beyond the base cover sheet, the projecting portion including a weld seam sealing the plastics sack.

6. The plastics sack according to claim 4, further comprising a pull strip having one end connected to a region of the second folded back side flap covered by the base cover sheet and one end projecting beyond the base cover sheet.

* * * * *